United States Patent [19]

Takase et al.

[11] Patent Number: 4,915,648

[45] Date of Patent: Apr. 10, 1990

[54] CONNECTOR WITH A LOCK MECHANISM

[75] Inventors: Akira Takase, Oota; Kunihiko Muraoka, Isezaki, both of Japan

[73] Assignee: Fuji Jukogyo Kabushiki Kaisha, Tokyo, Japan

[21] Appl. No.: 316,792

[22] Filed: Feb. 28, 1989

[30] Foreign Application Priority Data

Mar. 4, 1988 [JP] Japan ..... 63-028813[U]

[51] Int. Cl.[4] ..... H01R 13/64

[52] U.S. Cl. ..... 439/490; 439/353; 439/489; 439/924

[58] Field of Search ..... 439/353, 488–491, 439/924, 350, 352, 354, 357, 358, 355

[56] References Cited

U.S. PATENT DOCUMENTS 4,708,662 11/1987 Klein ..... 439/353

4,714,433 12/1987 Rider, Jr. ..... 439/357 X

FOREIGN PATENT DOCUMENTS 53-101638 8/1978 Japan .

*Primary Examiner*—Steven C. Bishop

*Attorney, Agent, or Firm*—Martin A. Farber

[57] ABSTRACT

A connector having a plug and a socket for receiving the plug. A first lock mechanism for locking the plug at a short inserting position, and a second lock mechanism for locking the plug at a long inserting position are provided. An indicator is provided for indicating a locked state by the second lock mechanism, thereby providing information that the plug is in an incomplete locking state.

7 Claims, 3 Drawing Sheets

CONNECTOR WITH A LOCK MECHANISM

BACKGROUND OF THE INVENTION

The present invention relates to a detachable connector with lock mechanism for an electronic device such as an electronic control system for automobiles.

Japanese Utility Model Application Laid-Open No. 53-101638 discloses a connector for electric equipment of automobiles. The connector comprises a plug, a socket, and a lock mechanism for holding a connecting state of a plug and socket so that disconnection of the plug from the socket may be prevented.

However, if the locking of the connector is incomplete, the plug may be disconnected from the socket with vibration of the connector or with shock at an impact of the automobile. If the connector is disconnected, dangerous trouble, such as an inoperative airbag, occurs.

In general, even if the lock of the connector is incomplete, electrical connection is kept. Accordingly, the incomplete locked state of the connector can not be recognized by the driver.

SUMMARY OF THE INVENTION

The object of the present invention is to provide a connector with a lock mechanism in which an incomplete locked state of the connector is indicated.

According to the present invention, there is provided a connector comprising a plug having contacts, a socket having a structure for receiving the plug and having pins engaged with the contacts, a first lock mechanism for locking the plug at a short insertion position, a second lock mechanism for locking the plug at a long insertion position, and indicator means for indicating locked state by the second lock mechanism, and the indicator means is a mark provided on the plug, which is exposed at the short insertion position.

The other objects and features of this invention will become understood from the following description with reference to the accompanying drawings.

DETAILED DESCRIPTION OF THE PREFERRED EMBODIMENT

Figure 1:
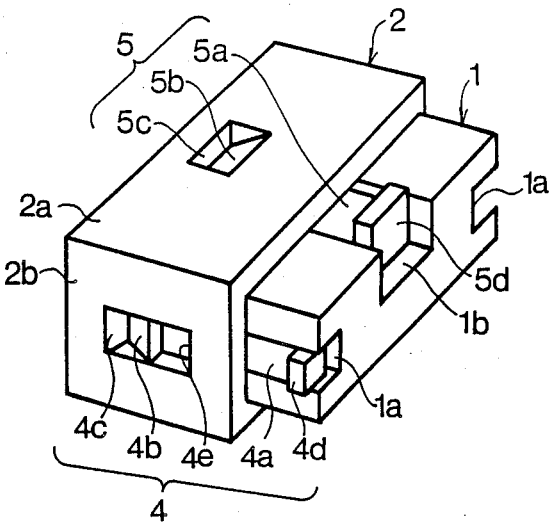
FIG. 1 is a perspective view of a connector with a lock mechanism according to the present invention.
Figure 2:
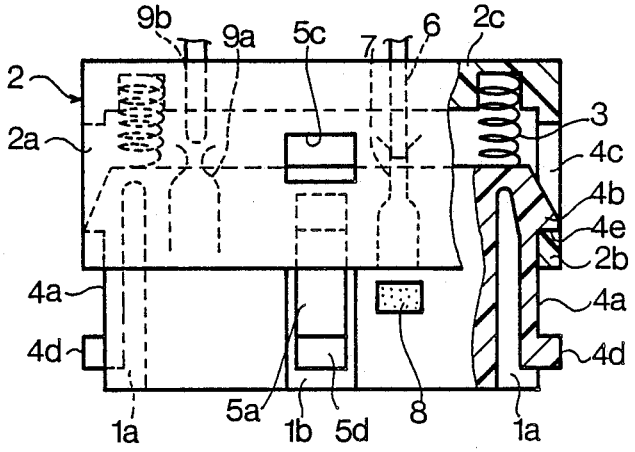
FIG. 2 is a plan view of the connector showing a pre-lock position of the lock mechanism, partly shown in section.
Figure 3:
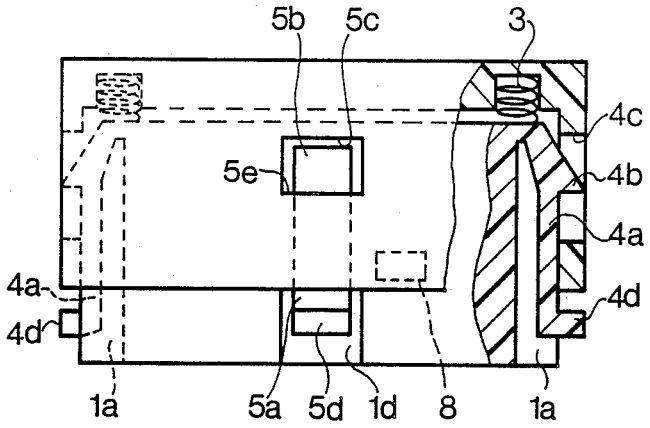
FIG. 3 is a plan view of the connector showing a lock position of the lock mechanism, partly shown in section.

Referring to FIGS. 1 to 3, a connector according to the present invention comprises a plug 1, and a socket 2 into which the plug 1 is inserted. The socket 2 has a box structure having an upper plate 2*a*, both side plates 2*b*, and an end plate 2*c*. A pair of coil springs 3 are provided in the end plate 2*c* of the socket 2 for outwardly urging the plug 1 when inserted.

As a lock mechanism, the connector is provided with a first lock mechanism 4 and a second lock mechanism 5, each of which is operated at different insert distances of the plug 1.

The first lock mechanism 4 comprises a pair of grooves 1*a*, 1*a* formed in right and left side walls of the plug 1, and a cantilevered resilient lock arm 4*a* disposed in each groove 1*a*. The resilient arm 4*a* extends in the inserting direction of the plug and has a hook 4*b* outwardly projected from a base portion thereof. A pair of rectangular openings 4*c* are formed on the side plates 2*b* of the socket 2. The hook 4*b* is adapted to be inserted into the opening 4*c* and engaged with an edge 4*e*. A boss 4*d* is formed at a free end of the resilient arm 4*a*. By inwardly pushing the boss 4*d* of both of the arms 4*a*, the hook 4*b* is disengaged from the edges 4*e*.

The second lock mechanism 5 comprises a groove 1*b* formed on an upper side of the plug 1 in the center thereof, a cantilevered resilient arm 5*a* formed to be disposed in the groove 1*b*, a hook 5*b* provided adjacent to a base portion of the arm 5*a*, a rectangular opening 5*c* formed on the upper plate 2*a* of the socket 2, having an edge 5*e* to be engaged with the hook 5*b*, and a boss 5*d* formed on a free end of the arm 5*a*. By pushing the boss 5*d*, the engaging hook 5*b* is disengaged from the opening 5*c*.

As shown in FIG. 2, the opening 4*c* of the first lock mechanism 4 is located at a short insertion distance, and the opening 5*c* is located at a long insertion distance.

As a connector terminal of the connector, a plurality of pins 6 are provided in the socket 2 and a plurality of resilient contacts 7 corresponding to the pins 6 are provided in the plug 1. Further, as a detector terminal, a pair of pins 9*b* is provided in the socket 2 (FIG. 6) and a pair of resilient contacts 9*a* are provided in the plug 1.

Figure 4B:
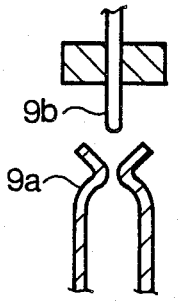
FIGS. 4*a* and 4*b* are illustrations showing a connector terminal and a detector terminal at the pre-lock position of the connector.
Figure 4A:
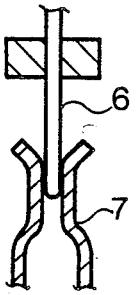

When the plug 1 is inserted into the socket 2 and the hooks 4*b* of the resilient arms 4*a* are engaged with the edges 4*e* of openings 4*c* of the socket 2, the plug is locked at a pre-lock position. As shown in FIG. 4*a*, the pin 6 is inserted into the contact 7 at the short insertion distance, where the pin 9*b* does not engage with the contact 9*a*.

Figure 5B:
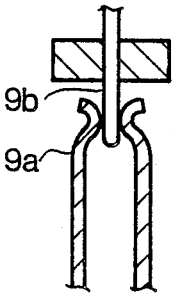
FIGS. 5*a* and 5*b* are illustrations showing the connector terminal and the detector terminal at the lock position of the connector.
Figure 5A:
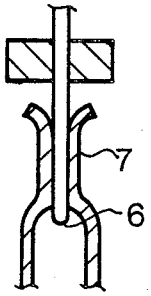

When the plug 1 is further inserted into the socket 2 and the hook 5*b* is engaged with the edge 5*e* of opening 5*c*, the plug 1 is finally locked so that each pin 6 is further inserted into the contact 7 up to the long insertion distance position as shown in FIG. 5*a*, where the pin 9*b* engages with contact 9*a*.

In order to indicate the fact that the plug 1 is finally locked to the socket 2, a mark 8 is provided on the upper side of the plug 1. In the pre-lock state by means of the first lock mechanism 4, the mark 8 is exposed on the surface of the plug 1. In the lock state by means of the second lock mechanism 5, the mark 8 disappears behind the socket 2.

Figure 6:
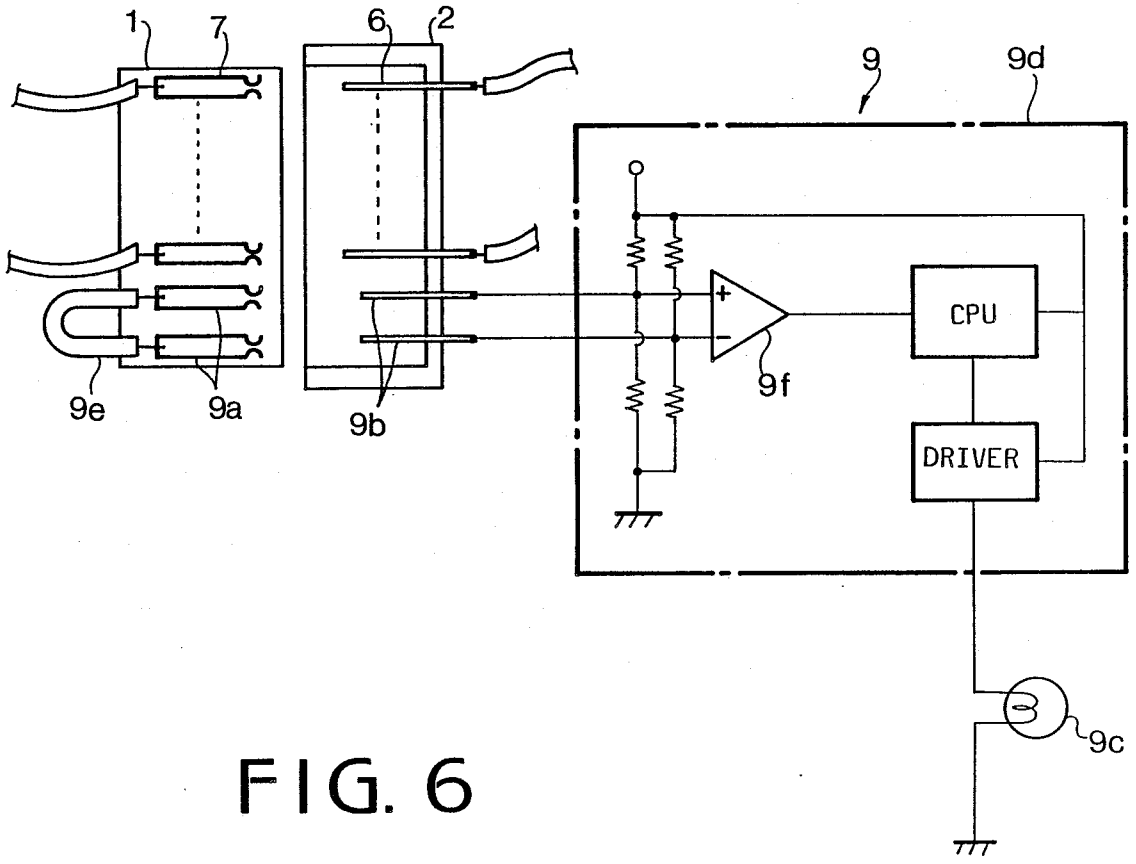
FIG. 6 is a diagram of an alarm device of the present invention.

Referring to FIG. 6, an alarm device 9 is further provided. The alarm device 9 comprises two detector terminals consisting of a pair of pins 9*b*, a pair of contacts 9*a*, a lighting control circuit 9*d* and an alarm lamp 9*c*. The contacts, 9*a* are connected to each other through a lead 9*e* and the pins 9*b* are connected to a comparator 9*f* provided in the lighting control circuit 9*d*. A CPU and a driver for driving the alarm lamp 9*c* are provided in the circuit 9*d*. When the pins 9 *b* do not engage with the contacts 9*a*, the comparator 9*f* produces an output signal to light the lamp 9*c*. When the pins 9*b* engage with the contacts 9*a*, the output of the comparator 9*f* becomes zero, so that the alarm lamp 9*c* is turned off.

Each pin 9*b* is shorter than the pin 6 in length. As described above, when the plug 1 is at the pre-lock position by means of the first lock mechanism 4, the pins 9*b* do not engage with the contacts 9*a*.

When the plug 1 is inserted into the socket 2 to an inner most position against the springs 3, the hook 5*b* is engaged with the edge 5*e* of the opening 5*c* as shown in FIG. 3. Thus, the connector is held in the lock position with the second lock mechanism 5 and the pins 6 are sufficiently engaged with the contacts 7 as shown in FIG. 5*a*. At the same time, the pins 9*b* engage with the contacts 9*a* as shown in FIG. 5*b*. Accordingly, the alarm lamp 9*c* is turned off and the mark 8 on the plug 1 is disappeared behind the socket 2.

If the locked state by the second lock mechanism 5 is incomplete, the plug 1 is pushed out by the springs 3 and held in the pre-lock position by the first lock mechanism 4 as shown in FIG. 2. The mark 8 is appeared on the plug 1 and the alarm lamp 9*c* is lighted. Thus, the incomplete lock state of the connector is indicated. Then, the plug 1 is pushed into the socket 2 so that the plug is finally locked by the second lock mechanism 5.

In present invention, if locked state by the second lock mechanism is incomplete, the plug is held to the pre-lock position by the first lock mechanism, and the incomplete connection is indicated.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A connector comprising:

a plug;

a socket having a structure for receiving the plug;

a first lock mechanism for locking the plug at a short interserting position;

a second lock mechanism for locking the plug at a long inserting position; and indicator means for indicating a locked state by the second lock mechanism; and wherein the indicator means is a mark provided on the plug, which is exposed at the short inserting position.

2. The connector according to claim 1 wherein each lock mechanism comprises a hook formed on the plug and an opening into which the hook is inserted.

3. In a connector comprising a plug, a socket having a structure for receiving the plug, said plug and socket constitute cooperating members, one of said members having contacts and the other of said members having pins engagable with the contacts, a first lock mechanism for locking the plug at a short inserting position of the plug in the socket, and a second lock mechanism for locking the plug at a long inserting position of the plug in the socket, the improvement wherein the connector further comprises detecting means comprising said pins and contacts for producing a different signal at the respective short inserting position and the long inserting position of the plug in the socket, and an electric indicator means responsive to the signal from the detecting means for indicating a locked state of the plug by the second lock mechanism at the long inserting position of the plug in the socket.

4. The connector as set forth in claim 3, wherein said electric indicator means includes a lamp and an alarm device, the latter being connected to said detecting means and to said lamp.

5. The connector as set forth in claim 4, wherein said alarm device comprises a CPU, a driver connected to said CPU and to said lamp, and a comparator having inputs connected to said pins and said contacts and an output connected to said CPU.

6. The connector as set forth in claim 3, wherein at least some of said pins and contacts are arranged such that said some of said pins and contacts engage each other in said locked state of the plug at the long inserting position.

7. The connector as set forth in claim 6, wherein said at least some of the pins and contacts are out of engagement with each other at said short inserting position, and other of said pins and contacts are arranged such that said other pins and contacts engage each other at the short inserting position.

* * * * *